US009286797B1

(12) United States Patent
Blandin et al.

(10) Patent No.: US 9,286,797 B1
(45) Date of Patent: Mar. 15, 2016

(54) TRAFFIC INCIDENT LOCATION IDENTIFICATION

(71) Applicant: International Business Machines Corporation, Armonk, NY (US)

(72) Inventors: Sebastien Blandin, Singapore (SG); Saif Eddin Jabari, Yorktown Heights, NY (US); Laura Wynter, Westport, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/592,929

(22) Filed: Jan. 9, 2015

(51) Int. Cl.

| | |
|---|---|
| ***G06G 7/76*** | (2006.01) |
| ***G08G 1/00*** | (2006.01) |
| ***G08G 1/01*** | (2006.01) |

(52) U.S. Cl.
CPC ..... *G08G 1/0125* (2013.01)

(58) Field of Classification Search
CPC ..... G08G 1/0125; G08G 1/0104; G08G 1/20; G08G 1/096716; G08G 1/096775; G08G 1/096741
See application file for complete search history.

(56) References Cited

U.S. PATENT DOCUMENTS

| | | | | |
|---|---|---|---|---|
| 6,470,261 | B1 | 10/2002 | Ng et al. | |
| 6,741,932 | B1 | 5/2004 | Groth et al. | |
| 7,145,475 | B2 | 12/2006 | Kavner | |
| 2011/0208417 | A1* | 8/2011 | Fink | G01C 21/3676 701/532 |
| 2012/0323474 | A1* | 12/2012 | Breed | B60W 30/04 701/117 |
| 2013/0289865 | A1 | 10/2013 | Miller et al. | |

FOREIGN PATENT DOCUMENTS

| | | | |
|---|---|---|---|
| EP | 1269447 | B1 | 12/2004 |
| EP | 1677271 | A1 | 7/2006 |
| EP | 2023308 | B1 | 5/2010 |
| EP | 1890274 | B1 | 9/2013 |
| WO | 2011058561 | A2 | 5/2011 |

OTHER PUBLICATIONS

Agarwal et al., "Exploiting Downstream Mobility to Achieve Fast Upstream Message Propagation in Vehicular Ad Hoc Networks," Proc. Mobile Networking for Vehicular Environments 2007, MCL Technical Report No. May 3, 2007, Anchorage, AK.

Karim et al., "Fast Automatic Incident Detection on Urban and Rural Freeways Using Wavelet Energy Algorithm," Journal of Transportation Engineering, vol. 129, No. 1, Jan./Feb. 2003, pp. 57-68, © ASCE.

(Continued)

*Primary Examiner* — Mary Cheung
(74) *Attorney, Agent, or Firm* — Laura E. Gisler; Daniel P. Morris

(57) ABSTRACT

A location for a traffic incident can be determined by a computer system, using data from a first and second sensor along a travel path. A receiving and sending symptom of the traffic incident are detected from a first and second sensor, using traffic flow data from the sensors. The locations of the first and second sensors are determined. The location and traffic flow data from each sensor are used to create a sending and receiving profiles. From the profiles, a convergence formula is build. Using the convergence formula and by determining a convergence point for the sending and receiving symptoms, a time and location of the traffic incident is identified.

18 Claims, 8 Drawing Sheets

(56) References Cited

OTHER PUBLICATIONS

Parkany et al., "A Complete Review of Incident Detection Algorithms & Their Deployment: What Works and What Doesn't," Prepared for the New England Transportation Consortium, Project No. 00-7, Feb. 7, 2005.
Payne et al., "Freeway incident detection algorithms based on decision trees with states," Transportation Research Record 682 (1978), pp. 30-37.
Singliar et al., "Towards a Learning Traffic Incident Detection System," Proceedings of the Workshop on Machine Learning Algorithms for Surveillance and Event Detection at the 23rd International Conference on Machine Learning, Pittsburgh, PA, 2006, Copyright 2006 by the author(s)/owner(s).
Tang et al., "Traffic-Incident Detection-Algorithm Based on Nonparametric Regression," IEEE Transactions on Intelligent Transportation Systems, Mar. 2005, vol. 6, No. 1, pp. 38-42, © 2005 IEEE DOI: 10.1109/TITS.2004.843112.
Weil et al., "Traffic Incident Detection: Sensors and Algorithms," Mathematical and Computer Modelling, vol. 27, No. 9-11, pp. 257-291, Copyright 1998 Elsevier Science Ltd.
Mell et al., "The NIST Definition of Cloud Computing," National Institute of Standards and Technology, U.S. Department of Commerce, Special Publication 800-145, Sep. 2011.
Kamarianakis et al., "System and Method for Incident Detection With Spatiotemporal Thresholds Estimated Via Nonparametric Quantile Regression," U.S. Appl. No. 13/927,245, filed Jun. 26, 2013.
Kamarianakis et al., "System and Method for Incident Detection With Spatiotemporal Thresholds Estimated Via Nonparametric Quantile Regression," U.S. Appl. No. 14/018,548, filed Sep. 5, 2013.
Blandin et al., "Traffic Network Sensor Placement," Filed Jan. 2, 2015.

* cited by examiner

TRAFFIC INCIDENT LOCATION IDENTIFICATION

BACKGROUND

The present disclosure relates to a system, method, and computer program product for locating traffic incidents, and more specifically, to use traffic data obtained from sensors to identify the location of traffic incidents.

Traffic management systems can integrate technology to improve the flow of vehicle traffic and improve safety. Often times, they use real-time traffic data from cameras and speed sensors to improve traffic flow.

SUMMARY

Embodiments of the present disclosure may be directed toward a computer implemented method for identifying a traffic incident location. The traffic incident location can be identified from a first and a second sensor by detecting, based on traffic flow data from the first sensor, a receiving symptom of the traffic incident relative to the first sensor. Based on traffic flow data from the second sensor, a sending symptom of the traffic incident relative to the second sensor can be detected. A location of the first sensor and the second sensor may be determined. A receiving profile for the receiving symptom may be created based upon traffic flow data from the first sensor and the location of the first sensor. A sending profile for the sending symptom may be created based upon traffic flow data from the second sensor and the location of the second sensor. From the sending and receiving profiles, a convergence formula may be build. Using the convergence formula, and based upon a convergence point for the sending and receiving symptoms, a time and the location of the traffic incident may be identified.

Embodiments of the present disclosure may also be directed toward a computer system for identifying a location of a traffic incident, from a first sensor and a second sensor. The system may include at least one processor circuit configured to detect a receiving symptom of the traffic incident relative to the first sensor, based on traffic flow data from the first sensor. The circuit may also be configured to detect a sending symptom of the traffic incident relative to the second sensor. The circuit may be configured to determine a location of the first and second sensors and create, based upon traffic flow data from the first sensor and the location of the first sensor, a receiving profile for the receiving symptom. It may also be configured to create, based upon traffic flow data from the second sensor and the location of the second sensor, a sending profile for the sending symptom. From the receiving and sending profiles, a convergence formula can be built. The circuit may also be configured to use the convergence formula to identify, based upon a convergence point for the sending and receiving symptoms, a time and location of the traffic incident.

Embodiments of the present disclosure may also be directed toward a computer program product for identifying a location of a traffic incident, from a first sensor and a second sensor. The computer program product can include a computer readable storage medium having program instructions embodied therewith, wherein the compute readable storage medium is not a transitory signal per se, and the program instructions are executable by a computer processing circuit to cause the circuit to perform the method that may include detecting, based on traffic flow data from the first sensor, a receiving symptom of the traffic incident relative to the first sensor. It may also include detecting a sending symptom of the traffic incident relative to the second sensor, based on traffic flow data from the second sensor. A location of the first and second sensors may be determined and from the traffic flow data from the first sensor and the location of the first sensor, a receiving profile for the receiving symptom may be created. Based upon traffic flow data from the second sensor and the location of the second sensor, a sending profile for the sending symptom can be created. The method may also include building, form the receiving and sending profiles, a convergence formula. Using the convergence formula and based upon a convergence point for the sending and receiving symptoms, a time and location of the traffic incident can be identified.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
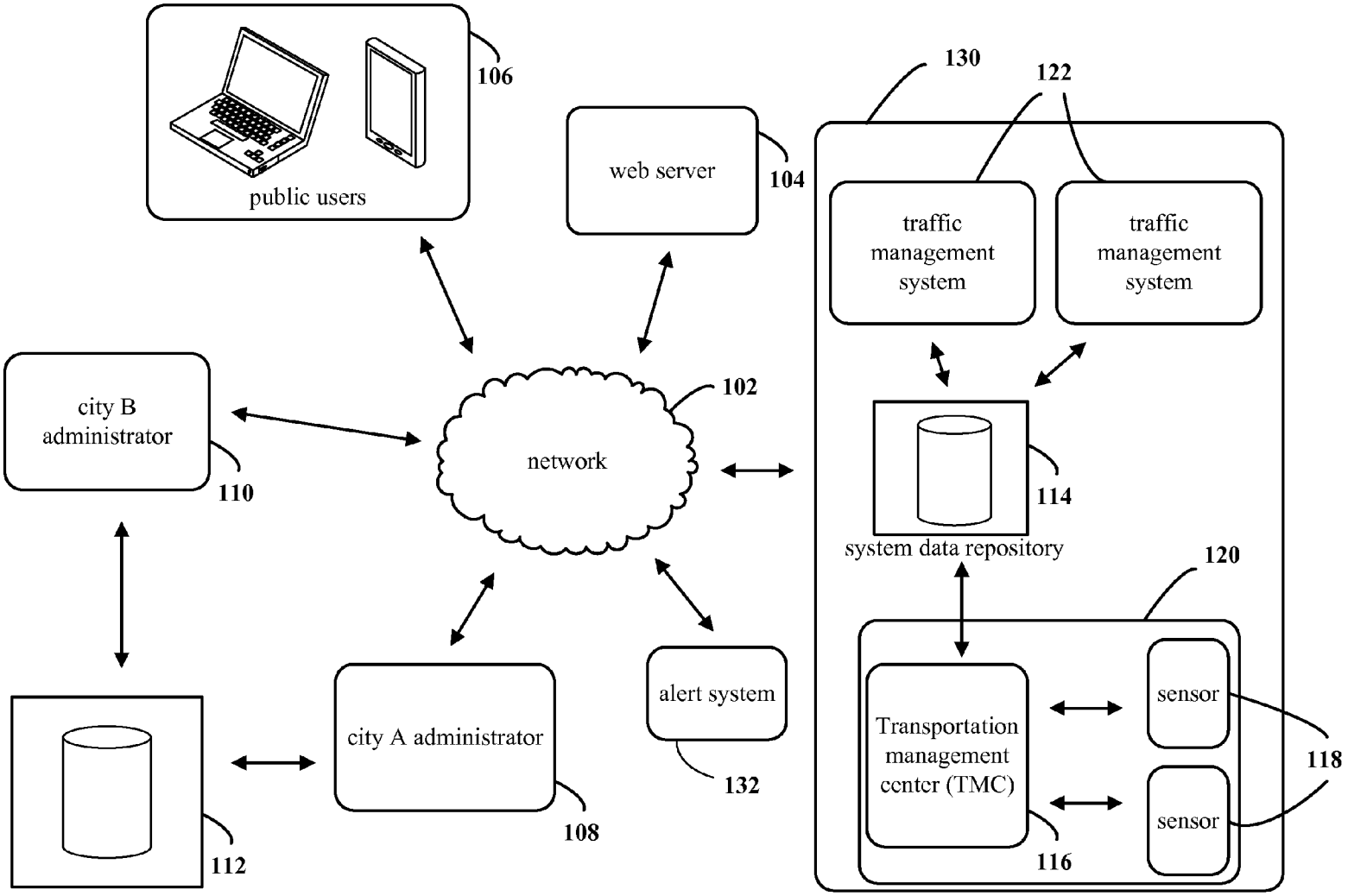
FIG. 1 depicts a system for determining a location of a traffic incident based on data collected from sensors along a traffic path and communicating the location with users, consistent with embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to the identification of traffic incidents along a path, more particular aspects relate to processing sensor data to identify a location of a traffic incident. While the present disclosure is not necessarily limited to such applications, various aspects of the disclosure may be appreciated through a discussion of various examples using this context.

In some instances of traffic management systems using automatic incident detection, the incident is detected only at the location of the traffic sensor itself. Thus, this detection was based on the detection that the traffic level at the sensor deviates from what it is expected to be. However, when detectors are widely spaced as is the case on some expressway networks, the location of the actual incident may be quite far from the location of the sensor. This can lead to imprecise and untimely location identification of a traffic incident. Aspects of the present disclosure are directed toward a method and system for identifying a location of a traffic incident using detection information from the sensors.

According to embodiments, a computer system can be configured to identify a location of a traffic incident, based on data received from a first sensor and a second sensor. The sensors send traffic flow data, but data received from the sensors may include information not necessarily related to traffic flow, and may include sensor location, date of installation, weather conditions, or others. The traffic data the system receives from the sensors can be generally termed traffic flow data and can include: traffic density (which can represent the mean number of vehicles at a specified time in a section of the road, divided by the section length), the mean rate of flow (based on vehicles crossing a specified position over a short interval of time), and the (space) mean speed of vehicles. The traffic flow data may also include other data about the traffic on a particular segment of the road. The system can be configured to detect, based on traffic flow data from the first sensor, a travel speed of a symptom of the traffic incident relative to the first sensor. A symptom can be a change in traffic variables of traffic flow such as traffic density, mean rate of flow, and mean speed of vehicles. For example, a symptom of a traffic incident could be detected by comparing a change in the rate of traffic to a threshold value. Throughout the disclosure, a traffic incident symptom can be discussed in terms of a shockwave, which as stated herein, describe the spatio-temporal evolution of traffic jams and their dissipation dynamics. Thus, symptom propagation can be conceptualized as a shockwave, consistent with descriptions of embodiments in the disclosure.

In some embodiments, the data indicating a symptom of a traffic incident, collected from each sensor, can be used to identify a sending and a receiving symptom. For example, a sending symptom could be a change in traffic conditions emanating from the traffic incident back toward a first sensor, against the flow of traffic. This could occur as a backup of traffic from the location of the incident back up the highway, against the direction of traffic, with the detectable location of the traffic change moving farther and farther upstream over time. A receiving symptom could then be a change in traffic conditions emanating from the location of the traffic incident, in the direction of traffic flow, toward a second sensor, where it is detected.

Consistent with embodiments, a computer system can be configured to identify a time and location of a traffic incident using a convergence formula. This formula can be built from data received or accessed from sensors and databases and created profiles, as detailed below. The system can detect a receiving symptom and a sending symptom of a traffic incident based on traffic flow data received from two sensors. The receiving symptom can be a symptom detected at a first sensor, and the sending symptom detected at a second sensor, with both symptoms emanating from a singular traffic incident. Using the traffic flow data and (or including) the location of the traffic sensors, a computer system can be configured to create a profile for each of the symptoms. For example, a sending profile can be created by configuring the system to detect, from the traffic flow data from the second sensor, traffic conditions including traffic density, a mean rate of flow and a (space) mean speed of vehicles. From these traffic conditions and based on the location of the second sensor, the sending profile can be created. This profile can include a speed of the symptom, a formula for deriving the speed, or other information.

According to embodiments, a profile could also be created to factor in weather and road conditions to the determination of the symptom propagation speed. For example, weather and road condition data could be collected relative to the location of the first and second sensor. The weather data could be collected from the national weather service or another source of weather data. The road condition data could be collected from a data repository that stores historical road conditions for sections of a travel path, received from a road condition monitoring service, or collected along the highway by another means. This weather and road condition data could be used to adjust the propagation speed of the sending and receiving symptoms, for use in building a convergence formula.

According to embodiments, a convergence formula can be built out of the receiving and sending profiles. This formula can be used to determine a convergence point for the sending and receiving symptoms. This determination could be made by iteratively determining a distance form a detecting sensor, as a function of time, for each of the sending and receiving symptoms. Then, based on the distances, the system could identify the particular convergence point. This point is the time and location of the traffic incident of interest. The system can then communicate the time and location of the incident to users.

Turning now to the figures, FIG. 1 depicts a system for determining a location of a traffic incident based on data collected from sensors along a traffic path and communicating the location with users, consistent with embodiments. The system can be a computer system comprising at least one processor circuit configured to carry out a method detailed herein. A traffic management system 120 comprises sensors 118 and a transportation management center 116 (herein TMC). A system 120 can incorporate other elements, too, but for ease of discussion sensors 118 and TMC 116 will be the elements discussed specifically. Sensors, two of which are illustrated at 118, may be placed along a travel path (e.g., a highway) to collect traffic flow data from the vehicles passing on the travel path. More detail on examples of the different types of the traffic flow data is included herein. The sensors 118 can communicate with TMC 116 in many ways, one of which can initiate when sensor of a plurality of sensors 118 transmits traffic flow data that indicates a symptom of a traffic incident to a TMC 116. For example, this detection of a symptom of a traffic incident could be based on a change that meets or exceeds a predetermined or threshold severity.

According to embodiments, TMC 116 can access data from a second sensor that indicates a symptom of a traffic incident, independently or in response to traffic flow data received from the first sensor. Data from sensors 118 can be continuously sent to the TMC, and the TMC can detect the incident from the data. These sensors, 118, can communicate over a network or in another manner, with TMC, 116. A transportation management center, per block 116, can receive and process the data collected by sensors 118. TMC, 116, can also access and process data from a data repository, as illustrated by the repository at block 114. This data can include information related to traffic flow specifically, collected from the sensors 118 and processed by the TMC 116 previously, or processed by another TMC, or input by a user, or another way. A data repository 114 can also include information not related to traffic flow specifically. For example, information regarding the location of sensors in the system, location of sensors outside the system, location of neighboring systems, maintenance data, or other data could be contained within the system data repository 114. As mentioned herein, the TMC, labeled 116, can access any of the data in a system data repository. In order to calculate a distance of a traffic incident, TMC 116 may use both real-time data collected from sensors 118 along a travel path and stored data, like location of specific sensors, from a system data repository 114. Additional detail on the processes that can occur at the TMC 116 is provided later in description and at FIG. 2.

As mentioned above, other traffic management systems may contribute and/or access data to a common system data repository. Traffic management systems, like those illustrated at blocks 122, may include a similar TMC and sensor communication setup as that of the traffic management system labeled 120. These systems can contribute traffic flow data to a data repository 114, as indicated by arrows between 114 and 122. These traffic management systems, 122, may also access data from a system data repository 114, where the data was contributed by another system, input by a user, or added by the system, as its own history. In some embodiments, a transportation management center can store data specific to its own system in a separate repository, and include some, but not all, of its collected data in a common system data repository 114.

According to embodiments, TMC 116, can process data collected from sensors 118 and accessed from a repository 114. This raw and processed data can be supplied to a customer or owner, like a city administrator (exemplar city administrators depicted are 108 and 110). For example, TMC 116 can receive traffic flow data from sensors 118. Based on the data from individual sensors, a symptom of a traffic incident can be detected. TMC 116 can then access data from two particular sensors on a shared travel path of the plurality of sensors 118.

In some embodiments, the data indicating a symptom of a traffic incident, collected from each sensor, can be used to identify a sending and a receiving symptom. For example, a sending symptom could be a change in traffic conditions emanating from the traffic incident back toward a first sensor, against the flow of traffic. A receiving symptom could then be a change in traffic conditions emanating from the location of the traffic incident, in the direction of traffic flow, toward a second sensor, where it is detected.

Consistent with embodiments, a profile can be built for each of the sending and receiving symptoms. Using the profiles, a convergence formula can be created. Based on a convergence point for the sending and receiving symptoms, as determined by using the convergence formula, a location and time of a particular traffic incident can be determined. This and other determinations can be made by a traffic management system 120.

Consistent with embodiments, this network of traffic management systems 130 can be accessed by a user such as a city "A" administrator 108. A city administrator 108, may access the traffic management system over one or more networks, labeled 102. The networks can include, but are not limited to, local area networks, point-to-point communications, wide area networks, the global Internet, and combinations thereof. As a primary user of the data, a city administrator can directly access the system 120 or the network of systems 130. A plurality of city administrators may have access to a particular system's data, over a network 102.

Consistent with embodiments, different users may have varying levels of access to the traffic data. For example, city A administrator 108 may be a primary customer or owner of a traffic management system 120, of the collection of sensor-TMC systems 122 and the respective system data repository 114, or of the whole network of traffic management systems 130. Thus, as mentioned herein, city A administrator 108 may have direct access to the system's data repository 114, including raw data collected from sensors 118. City "B", however, could join a cooperative or partnership for traffic control, and the city "B" administrator 110 could be granted partial access to the data collected and processed by a city A system 120 or network of systems 130 (i.e. the systems pictured here including systems 120 and 122, with the system data repository 114 and the TMC-sensor 116 and 118 therein). City B administrator could access, for example, the processed data but not the raw data collected by the sensors 118 and stored in a system data repository 114. Similarly, city B administrator's 110 access could be restricted by the number or location of systems, where, for example, city B administrator 110 could access the traffic management system depicted in 120 but would not have access to the 122 systems.

According to certain embodiments, users such as city administrators 108 and 110 depicted here could access other data from a data repository 112, that could be incorporated into the data accessed from the traffic management system 114. For example, in an effort to effectively plan and manage snow removal processes, a city A administrator 108, could access data from a network of traffic management systems 130, and also use data from a weather service stored in a repository 112, or accessed directly from the national weather service or another source in order to determine the best times and places to clear the snow, in order to have the least significant impact on commuting times and traffic flow. A city administrator user like 108 or 110 could also access data in a repository 112 that pertains to emergency response calls and response times for each of their cities or for a particular geographic area. Using the data collected from the network of traffic management systems 130 and the emergency data mentioned above and stored in a repository 112, a city administrator could determine the effectiveness of its particular city's emergency response, consider areas for improvement, and determine funding allocations accordingly. For example, various traffic-related data could be compared with call-to-arrival response times for an emergency vehicle dispatch, in order to determine how traffic flow may have played a factor in a delayed response, versus another non-traffic-related inefficiency. Improvements, resources, and attention could be focused accordingly.

In certain embodiments, traffic incident location data from a network of traffic management systems 130 could be communicated directly over a network to an alert system 132. This system could communicate with variable message signs on highways connecting to the road with the traffic incident, or it could communicate the message directly to users who have subscribed to the alert system 132.

Other even less privileged users could access some data from the network of traffic management systems 130, in varying levels. For example, public users, two of which are depicted at 106, could access portions or versions of the processed traffic flow data and determined incident location from a network of traffic management systems 130 or the network 102. These users 106, could be, for example, less privileged customers, like web and phone technology developers interested in analyzing the data in order to research improvements and develop applications accordingly. Other less privileged customers could be mapping companies or navigation device manufacturers. Public users 106 could also be emergency dispatch computers or servers. The incident time and location could be transmitted to an emergency dispatch system's computer or server. The incident time, location and speed of symptom travel in each direction could be transmitted to a police department or other party interested in real-time traffic data.

According to embodiments, web servers, illustrated at block 104, could access the traffic management systems and data 130 over a network 102. These servers could provide an interface for users such as drivers to access traffic information about traffic incident locations, estimate travel time, or best routes based on historical averages of traffic incidents along a particular travel path or set of travel paths. For example, a location of a traffic incident could be sent to a driver's smart phone. The traffic incident could be via a web server 104 by a user's personal computer or laptop, for use in trip planning and travel time calculations.

Figure 2:
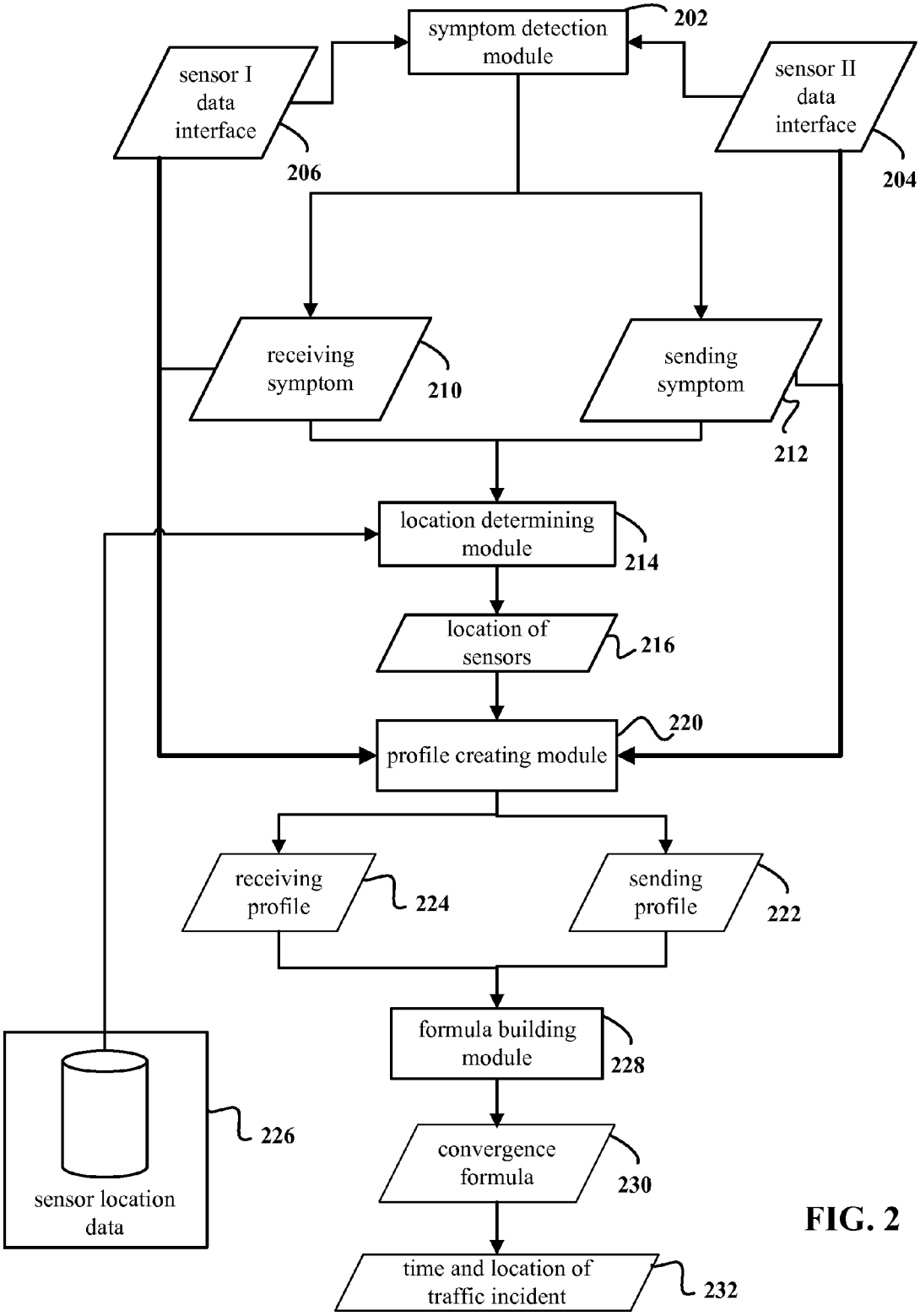
FIG. 2 depicts a data flow diagram for a system to determine an incident location, according to embodiments.

FIG. 2 depicts a data flow diagram for a system to determine an incident location, according to embodiments. The computer system of FIG. 2 can comprise at least one computer processor circuit, which can be configured to include the modules listed herein, or others. The modules listed in the figure can reside in a transportation management system (TMC), like the one pictured in FIG. 1. They can also reside in another location within the system. The figure depicts the flow of data across modules, as labeled and indicated by parallelograms, with rectangles signifying modules. The flow begins when a symptom detection module 202 detects a symptom of a traffic incident. For instance, this could be an increase or decrease in a flow of traffic relative to a norm, predetermined threshold, or determined in another manner. The symptom detection module can be in communication with traffic sensors along a travel path (e.g. a highway) either continuously or at scheduled intervals, with the traffic sensors sending traffic flow data collected at the site of the sensor to the TMC. This data can be received by the TMC via a sensor data interface. In this figure, two interfaces have been illustrated, sensor I at block 206 and sensor II at block 204. A symptom detection module 202 receives a steady stream of traffic flow data from at least each of these two interfaces.

When, based on the data received from sensor interface I at block 206 and sensor interface II at block 204, symptom detection module at block 202 detects symptoms that correspond to a single traffic incident, the detection module 202 prompts a symptom detector module 208 to access traffic flow data from each of the sensor interfaces 206 and 204 in order to identify a receiving symptom 210 and a sending symptom 212. A receiving symptom may be a symptom emanating from a site of the traffic incident toward sensor I, and is detected by sensor I. Similarly, a sending symptom may be a symptom originating from the traffic incident and moving toward sensor II, and it is the symptom that was detected by sensor II.

Consistent with embodiments, a location determining module 214, can determine the location of the relevant sensors, sensor I and II. As mentioned herein, this determination may be made by accessing stored sensor data from a sensor location database 226, as depicted here. The sensor location may also be determined by prompting a real-time receipt of sensor location data from each of the relative sensors. The location of the sensors 216, can be used by the profile creating module 220, as can the data on the sending and receiving symptoms 212 and 210, respectively. The profile creating module 220 may also access traffic flow data from the sensors via sensor I and sensor II data interfaces 206 and 204, respectively.

According to embodiments, using the above described data, a profile creating module 220 can create a receiving profile 224 and a sending profile 222. From the profiles, a formula building module 228 can build a convergence formula 230. This formula 230 can be used to determine the time and location of the traffic incident 232. Consistent with some embodiments, the traffic incident location and time can be determined to be the point of convergence of the location and time for the two symptoms—the sending and receiving symptoms 212 and 210, respectively. For instance, this can be determined by solving iteratively, using the symptom profiles, the particular location of each incident at particular times, stepping back from the time of detection at each sensor at set intervals, in order to determine a time and location at which the two converge, i.e. the time and location of the traffic incident 232.

Figure 3:
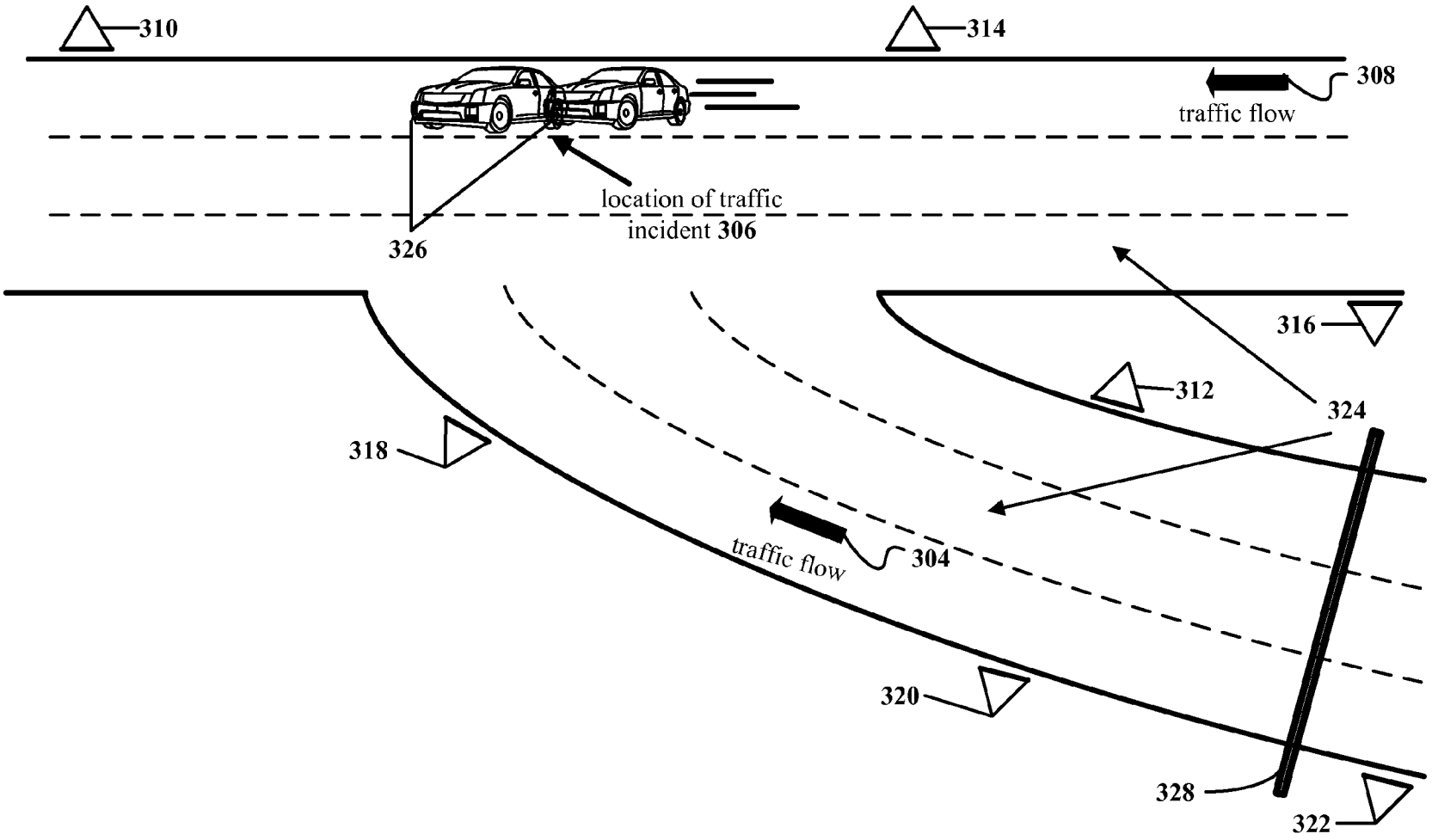
FIG. 3 depicts a use case of the sensors, along a travel path, according to embodiments.

FIG. 3 depicts a use case of the sensors, along a travel path, according to embodiments. The spaces labeled 324 depict an example of a travel path, a highway, as one road merges into another. The arrows 308 and 304 show the direction of the flow of traffic, with traffic moving in a single direction, and the merging traffic joining the flow. The objects labeled 326 are cars that have just experienced a collision. In this example, the car collision is the traffic incident of interest. A traffic incident can be a variety of different events that affect the flow of traffic. For example, a traffic incident might be a collision of vehicles; it can also be another occurrence which causes a change in traffic flow for example, the path of an emergency vehicle, a traffic jam, a stalled car on the shoulder of the road, or another traffic occurrence of note. The location of the incident 306, is noted at the collision site; according to embodiments, this is the location which can be determined using sensor data. At regular points along the highway, triangles labeled 310-322 mark the location of traffic sensors. The bold side of the triangles emphasize the traffic-facing aspect of each sensor, and indicate a directness aspect of the sensor's data collection. These sensors need not be evenly spaced, nor does there need to be any more than two sensors in order for a location to be calculated; however, the figure illustrates a highway arrangement where a traffic monitoring system is in use with multiple sensors. The sensors along each road, herein collectively 310-322, can gather traffic flow data from the vehicles passing along the highway. The sensors 310-322 may collect data regarding the number of vehicles, the speed of vehicles, the density of traffic, and/or other information. The sensors 310-322 can transmit this traffic flow data to a transportation management center (TMC).

In some embodiments, a TMC will detect a change in the traffic flow data from sensor 310, and identify it as a symptom of a traffic incident. In response to the detection of the symptom, the system can access traffic flow data from sensor 314. Using the information from each sensor, the system can build a convergence formula and determine the time and location of the traffic incident 306. This data can be reported to a number of outlets, as described herein. For example, the time and location, alone or with other data, can be sent to an alert system, which can then broadcast the time, location and other data onto a variable message sign 328. As depicted in this figure, the variable message sign 328, could be on a connecting highway, in order to alert incoming vehicles of specifics of the traffic incident on the travel path ahead.

Figure 4:
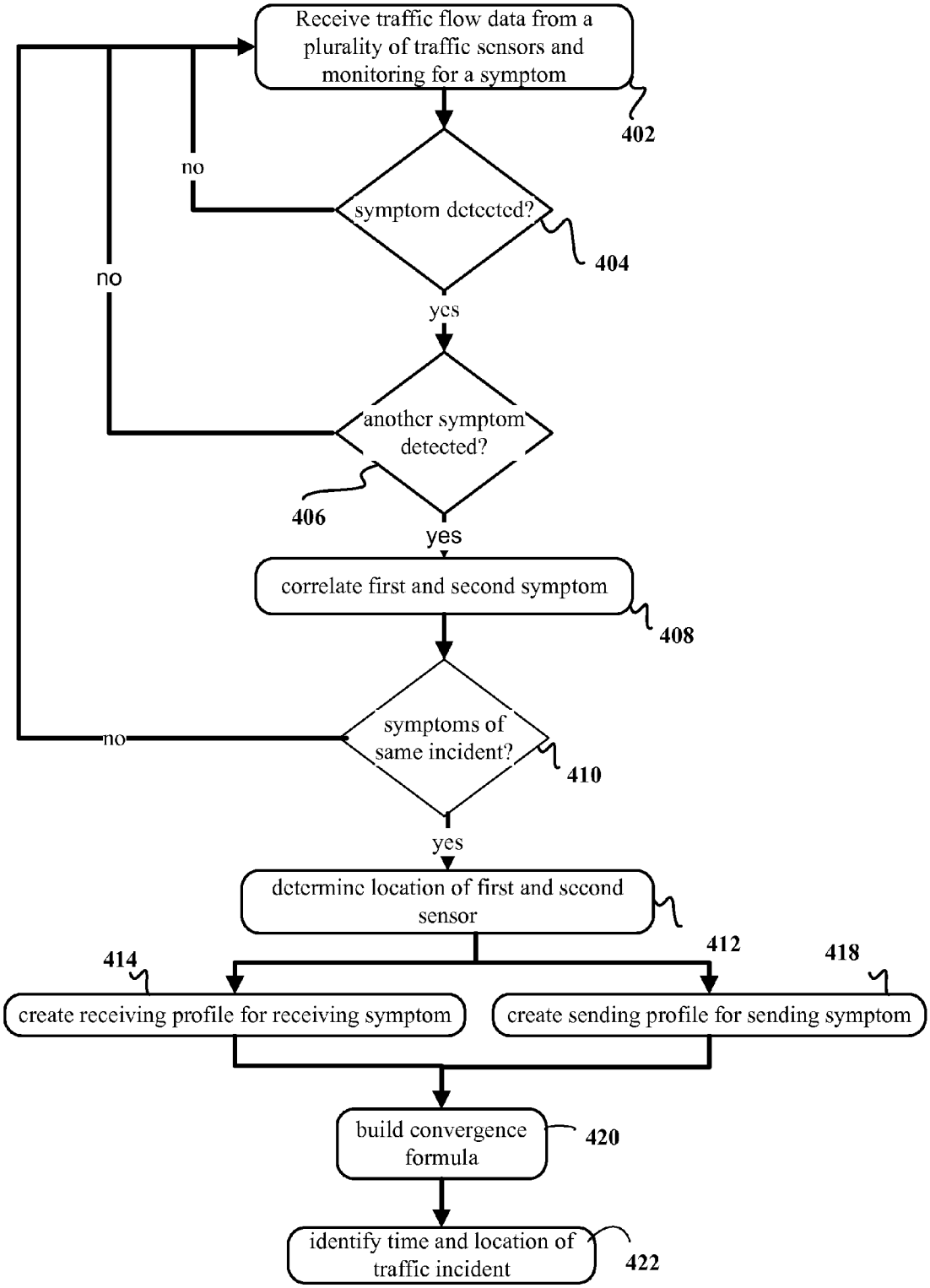
FIG. 4 depicts a flow of a method for determining the location of a traffic incident relative to two traffic sensors, according to embodiments.

FIG. 4 depicts a flow of a method for determining the location of traffic incident relative to two traffic sensors, according to embodiments. The flow can begin at block 402 where the system can receive traffic flow data from a plurality of traffic sensors and monitors the incoming data for a symptom of a traffic incident. The system can be set up to continuously receive data from the sensors. As described herein, the system can detect a symptom of a traffic incident, per 404. If not incident is detected, the system can return to monitoring for a symptom and receiving data from the sensors, per 402.

Upon detection of a first symptom, a second symptom along the same travel path can be detected, per 406. If a second symptom is not detected, the system returns to monitoring for symptoms of a traffic incident from the data it continues to receive from sensors. Once two symptoms along the same travel path have been detected, the system can correlate the first and second symptom, per 408, to determine if the two symptoms are caused by the same traffic incident, per 410. If at 410, the symptoms are not caused by the same incident, the system can return to the beginning of the flow at 402, and continue the process of symptom detection. If the symptoms are caused by the same incident, the system can proceed to 412.

According to embodiments, a location of the first and second sensors can be determined, per 412. This determination, as mentioned herein, can be made by accessing a database containing sensor location data. The location of the sensors could also be determined by receiving location data from the sensors, upon a prompting or at a regularly scheduled time.

Consistent with embodiments, a system can then create a profile for each of the two symptoms: the receiving symptom per 414 and the sending symptom per 418. As mentioned above, these profile and symptoms names can relate to the sensors at which they were detected, with a sending profile created for a sending symptom so named for having been detected at a first sensor and a receiving profile for the receiving symptom that was detected by the second sensor on the travel path. The profiles can include symptom speed formulas.

From the profiles for the sending and receiving symptoms, the computer system can be configured to build a convergence formula, per 420, to identify the location and time of the traffic incident from which the symptoms originated (i.e. where the two symptoms converge), per 422. According to some embodiments, the location can be determined by iteratively calculating the location of each of the symptoms at increasingly further points in time backwards from the symptom's time of detection at the respective sensor. Thus, the location of the symptom is identified at increasingly further distances away from its sensor of detection as the time steps back into history increase. The point of convergence of the two symptoms (as their location is identified moving further back in time and further away from each sensor, toward the source i.e. the location of the incident).

Figure 5:
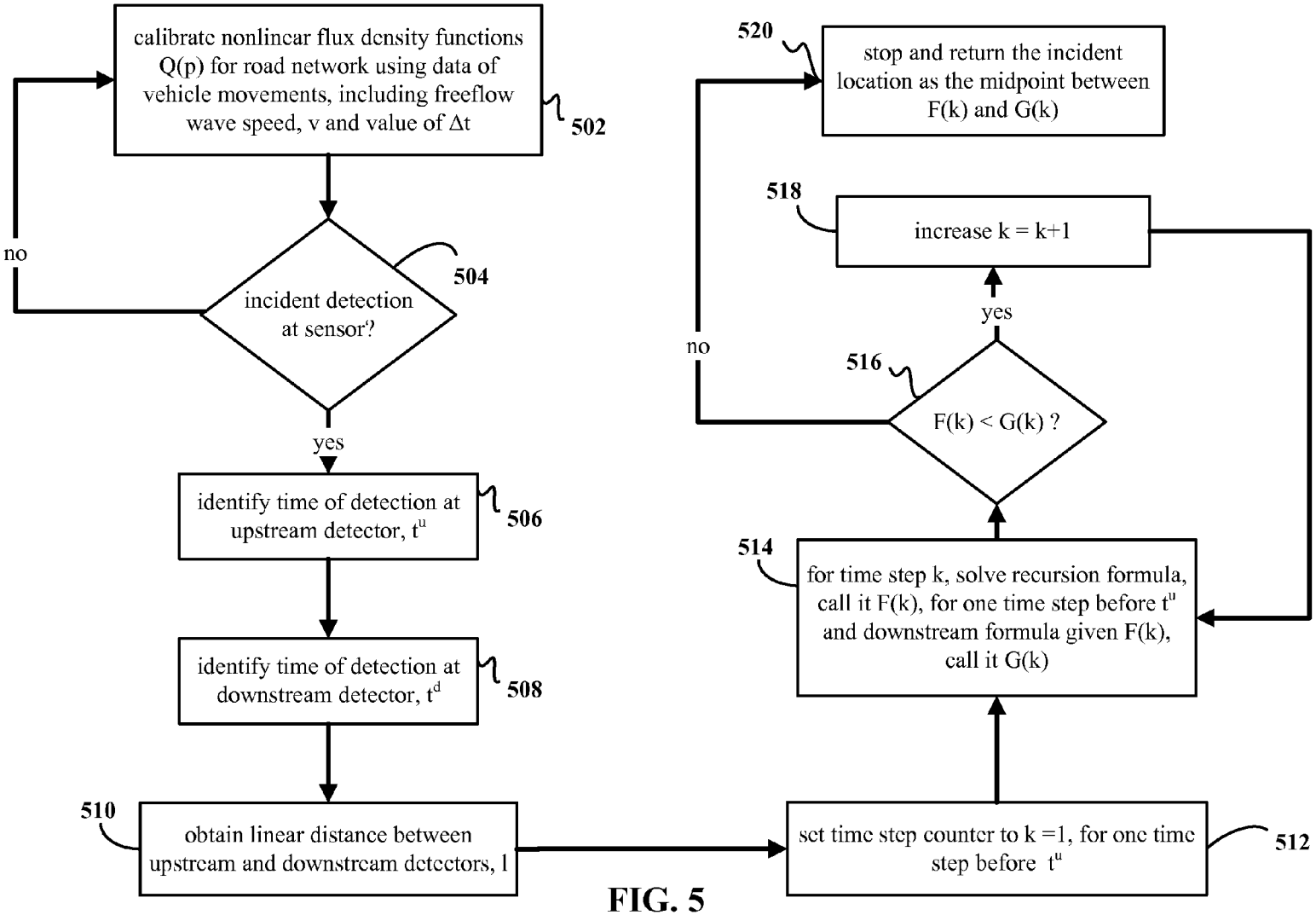
FIG. 5 depicts a flow of a method for determining the location of a traffic incident using time of detection at two sensors, according to embodiments.

FIG. 5 depicts a flow of a method for determining the location of a traffic incident using time of detection at two sensors, according to embodiments. The flow begins at 502, when nonlinear flux density functions Q(p) for road networks using data of vehicle movements, including free flow wave speed, v and value of Δt, are calibrated. These calculations can occur at scheduled intervals, for example monthly. The calculations could also occur in response to receiving traffic flow data, i.e. on a continual loop. The functions may be calibrated using data updated on a scheduled interval or on a loop. Thus, in some embodiments, nonlinear flux density functions may be calibrate offline, or may be done using real-time data. The nomenclature of the function correspond to an embodiment described after the figures, but the method described herein is not intended to be limited by that particular formulation. Rather, the variable nomenclature is provided in many of the steps of this figure in order to provide clarity and allow for association of concepts described herein with examples of embodiments.

Based on sensor data, an incident may be detected, per 504. If an incident has not been detected at 504, by one of the fixed sensors, the system continues to calibrate the functions using the data as described above, per block 502. If however, an incident is detected, a system can identify the time of detection at one sensor, specifically an upstream sensor or detector, $t^u$, per 506. A time of the detection of the incident at the downstream detector, $t^d$, can be identified, per 508. Per 510, a system can obtain a linear distance between upstream and downstream detectors, l. For example, this could be the distance on a travel path between two adjacent sensors; it could also be a distance along a shared travel path between two nonadjacent sensors.

Using the linear distance 1 and the times of detection at each sensor, a system can calculate the location of an incident by setting a time step counter to k=1, for one time step before $t^u$, at 512. Using formulas described in the present disclosure, solve F(k) (a recursion formula for time step k); also solve G(k) (at one time step before $t^u$ and downstream formula given F(k)), at 514. At 516, determine if F(k)<G(k). If so, increase the value of k by one, at 518, by following the arrow back to block 514, resolve for F(k) and G(k) at 514. At block 516, if F(k)<G(k) is not true, a traffic incident location may be determined as the midpoint between F(k) and G(k), at 520. A system can stop and return the location, as per 520.

Some embodiments may use first-order continuum traffic flow models in determining the location of the traffic incidents. First-order continuum traffic flow models can describe the spatio-temporal evolution of three variables of traffic flow: (i) the traffic density, denoted ρ(x,t), which represents the mean number of vehicles at time instance $t \in \mathbb{R}_+$ in a "small" section of road, relative to the distance between detectors, $$\left(x - \frac{1}{2}dx,\ \ x + \frac{1}{2}dx\right),$$

divided by the section length dx; (ii) The mean rate of flow, q(x,t), crossing position $x \in \mathbb{R}$ over the short time interval $$\left(t - \frac{1}{2}dt,\ \ t + \frac{1}{2}dt\right);$$

(iii) the (space) mean speed of vehicles, v(x,t) in (x−dx,x+dx) during (t−dt,t+dt). By definition of the traffic variables, q=ρv and, consequently, any two of the three macroscopic variables can be used to describe traffic conditions along the road. A natural rule is the conservation of vehicles (or traffic densities) along the road. In the absence of sources and sinks, this rule is given by:

$$\frac{\partial \rho}{\partial t} + \frac{\partial q}{\partial x} = 0 \tag{1}$$

To close the conservation equation, an "equilibrium" flow-density relation can be used: $q \equiv Q_e(\rho)$, which can be a non-linear concave relation (also known as the "fundamental diagram" of traffic flow). The resulting model is a non-linear scalar conservation law:

$$\frac{\partial \rho}{\partial t} + \frac{\partial Q_e(\rho)}{\partial x} = 0 \tag{2}$$

To solve (2), knowledge of initial traffic conditions can be used; this can be given by a prescribed initial traffic density profile: $\rho(x,0)\equiv\rho_0(x)$ for all $x\in\mathbb{R}$. According to embodiments, this data for the traffic density profile can be collected by sensors located along a travel path. The solution of (2) can indicate discontinuities known as shockwaves. Shockwaves describe the spatio-temporal evolution of traffic jams (and their dissipation dynamics). These shockwaves can indicate that a traffic incident has occurred in a location relative to the wave and its direction. These shockwaves can be the same as those referred to above in descriptions of the figures.

The speed and direction of a shockwave can depend on the traffic conditions on either side of the shock-front. This is given by:

$$\frac{dx_t^s}{dt} = \frac{Q_e(\rho(x_t^s-,t)) - Q_e(\rho(x_t^s+,t))}{\rho(x_t^s-,t) - \rho(x_t^s+,t)}, \tag{3}$$

where $x_t^s$ denotes the position of the shock-front at time t and $x_t^s-$ and $x_t^s+$ denote, respectively, the positions immediately upstream and immediately downstream the shock-front. For example, if on a highway, with traffic across all lanes moving in a single direction, from 0 to l, traffic upstream would be closer to 0 and traffic downstream would be closer to l, the language indicating the stream of traffic along a highway. For example, $x_t^s-$ can denote a position immediately upstream of a traffic flow, while $x_t^s$ can denote a position immediately downstream (i.e. following further along a path in the same direction) of a traffic flow. As a special case, in the presence of a single discontinuity within a road section and uniform traffic densities upstream and downstream the shock-front, denoted $\rho_u$ and $\rho_d$, the shock speed would be a constant given by:

$$v^s = \frac{Q_e(\rho_u) - Q_e(\rho_d)}{\rho_u - \rho_d} \tag{4}$$

Consider a section of roadway of length l (i.e., $x\in[0,l]$) with fixed traffic sensors at the boundaries providing flow measurements at successive time intervals. This could be an example of the case mentioned in figures above, wherein the traffic sensors were communicating with the transportation management center at regular or scheduled intervals. The traffic densities at the boundaries, x=0 and x=l, respectively, are given by:

$$\rho(0,t+) = \begin{cases} S_e^{-1}(q_0^m(t)) & \text{if } q_0^m(t) < R_e(\rho(0,t)) \\ \rho(0,t) & \text{if } q_0^m(t) \geq R_e(\rho(0,t)) \end{cases} \tag{5}$$

and $$\rho(l,t+) = \begin{cases} R_e^{-1}(q_l^m(t)) & \text{if } q_l^m(t) < S_e(\rho(l,t)) \\ \rho(l,t) & \text{if } q_l^m(t) \geq S_e(\rho(l,t)) \end{cases} \tag{6}$$

where $q_0^m(t)$ and $q_l^m(t)$ are measured boundary flows, $\rho(0,t+)$ and $\rho(l,t+)$ are boundary traffic densities, and $S_e$ and $R_e$ are equilibrium sending and receiving functions (sometimes referred to as equilibrium demand and supply functions, respectively).

Suppose initially that a traffic incident takes place at an arbitrary position along the section of road $x^i\in(0,l)$ at time $t^i>0$, both assumed to be unknown. Assume $Q_e$ is a triangular relation with parameters, calibrated from sensor data, $v_f$, $q_{max}$, $\rho_{jam}$, $\rho_{crit}$, and w, which denote free-flow speed, capacity, jam density, critical density, and backward wave speed. A consequence of the assumption of a triangular $Q_e$ is that variations in traffic density within the same regime (free-flow or congestion) have no impact on the wave speed.

The incident results in a change in traffic conditions at the unknown time and location $(x^i,t^i)$ to the flow and density $(q^i,R_e^{-1}(q^i))$. Assume free-flow traffic conditions throughout the road section up to but not necessarily including the time of the incident, $t\in[0,t^i)$. Define also $q(0,t)=q_0^m(t)$, $\rho(0,t)=S_e^{-1}(q_0^m(t))$, and likewise for the downstream boundary.

Conditions that may be necessary (i.e. minimum traffic needed at the time of the incident) are indicated in the following description, with free flow traffic indicating a lack of congestion and thus a lack of an incident symptom, versus a higher traffic density which would provide for symptom detection. If at the time of the incident, $R_e^{-1}(q^i)\leq\rho_{crit}$, then the severity of the incident is low and traffic conditions remain in free-flow. If, on the other hand, at the time of the incident, $R_e^{-1}(q^i)>\rho_{crit}$, then a shockwave is triggered.

For example, suppose initially that the boundary traffic densities are constant during the time interval $t\in[0,t^i)$. In this case, the speed of the shockwave is constant and can be given by:

$$v^s = \frac{Q_e(\rho_0(0)) - q^i}{\rho_0(0) - R_e^{-1}(q^i)} = \frac{q_0^m(0) - q^i}{\rho_0(0) - R_e^{-1}(q^i)}. \tag{7}$$

For example, here there are two cases: (i) $v^s>0$ indicating a downstream moving shockwave, which can be detected at the downstream boundary sensor; (ii) $v^s<0$ indicating an upstream moving shockwave that can be detected at the upstream boundary sensor. For example, the latter case can be used, because this case can indicate a more severe incident, relative to the former case. When the shockwave reaches the upstream boundary of the road (x=0), the measured flow rate drops to $q^i$ at x=0 at some time $t^u>t^i$. Likewise, the traffic density increases to $R_e^{-1}(q^i)$. From this, the wave speed at the upstream boundary can be calculated by replacing $\rho_0(0)$ with $\rho(0,t^u-)$ in (7). Consequently:

$$x^i=v^s(t^u-t^i) \tag{8}$$

Additionally, a drop in both flow rate and traffic density could be detected at the downstream sensor at some time $t^d>t^i$. The flow rate detected at the downstream sensor can be $q^i$ coupled with a (sub-critical) traffic density of $S_e^{-1}(q^i)$. The speed of the downstream moving wave can be $v^f$ and the following case applies:

$$x^s=l-v_f(t^d-t^i) \tag{9}$$

From (8) and (9), the time of the incident can be determined from boundary sensor measurements as:

$$t^i = \frac{v^s t^u + v_f t^d - l}{v^s + v_f}$$

and the position of the incident can be calculated using either (8) or (9).

When traffic densities at the boundaries vary within a free-flow regime, the speed of the downstream moving wave can remain $v_f$, but the upstream propagating shockwave may no longer be constant. At any time $t^i<t<t^u$, the speed can be given by:

$$\frac{dx_t^s}{dt} = \frac{Q_e(\rho(x_t^s -, t)) - q^i}{\rho(x_t^s -, t) - R_e^{-1}(q^i)} \tag{10}$$

Integrating (10) and noticing that $$\rho(x_t^s -, t) = \rho\left(0, t - \frac{x_t^s}{v_f}\right)$$

and $$Q_e(\rho(x_t^s -, t)) = q_0^m\left(t - \frac{x_t^s}{v_j}\right),$$

the following:

$$x_t^s - x_{t^i}^s = x_t^s - x^i = \int_{t^i}^{t} \frac{q_0^m\left(z - \frac{x_z^s}{v_j}\right) - q^i}{\rho\left(0, z - \frac{x_z^s}{v_f}\right) - R_e^{-1}(q^i)} dz$$

When $t=t^u$, the following:

$$x^i = \int_{t^i}^{t^u} \frac{q^i - q_0^m\left(z - \frac{x_z^s}{v_f}\right)}{\rho\left(0, z - \frac{x_z^s}{v_f}\right) - R_e^{-1}(q^i)} dz \tag{11}$$

since $x_{t^u}^s=0$.

A numerical schema can be devised to compute $x^i$ and $t^i$ as follows: Let $x_{t^i+k\Delta t}^s$ denote the position of the shock-front after $k\in\mathbb{N}$ small discrete time steps of length $\Delta t$ from the time it is triggered. From (10):

$$x_{t^i+\Delta t}^s - x^i = \frac{q_0^m\left(t^2 + \Delta t - \frac{x^i}{v_f}\right) - q^i}{\rho\left(0, t^i\Delta t - \frac{x^i}{v_f}\right) - R_e^{-1}(q^i)}\Delta t \tag{12}$$

Equation (12) has three unknowns: $x_{t^i+\Delta t}^s$, $x^i$, and $t^i$. At the next time step:

$$x_{t^i+2\Delta t}^s - x_{t^i+\Delta t}^s = \frac{q_0^m\left(t^i + 2\Delta t - \frac{x^i}{v_f}\right) - q^i}{\rho\left(0, t^i + 2\Delta t - \frac{x^i}{v_f}\right) - R_e^{-1}(q^i)}\Delta t \tag{13}$$

This introduces one new unknown variable, $x_{t^i+2\Delta t}^s$. In general:

$$x_{t^i+(k+1)\Delta t}^s - x_{t^i+k\Delta t}^s = \frac{q_0^m\left(t^i + (k+1)\Delta t - \frac{x^i}{v_j}\right) - q^i}{\rho\left(0, t^i + (k+1)\Delta t - \frac{x^i}{v_f}\right) - R_e^{-1}(q^i)}\Delta t \tag{14}$$

Let $t^i+k^u\Delta t=t^u$ denote the time interval during which the incident is detected at x=0. Consequently, $x_{t^i+k^u\Delta t}^s=0$. Combining (12) through (14) with (9), the result is the system of $k^u+1$ equations and $k^u+1$ unknowns. However, since $t^i$ is unknown, then so is $k^u$. As an alternative, determinations proceed backwards in time starting from the time the incident is detected at position x=0. The position of the shock-front $\Delta t$ earlier is given by:

$$x_{t^u-\Delta t}^s = \frac{q^i - q_0^m(t^u - \Delta t)}{\rho(0, t^u - \Delta t) - R_e^{-1}(q^i)}\Delta t \tag{15}$$

From (9) if $x_{t^u-\Delta t}^s \geq l - v_f(t^d - t^u + \Delta t)$ then $x^i = x_{t^u-\Delta t}^s$ and $t^i = t^u - \Delta t$. The position of the shock-front one step earlier can be computed:

$$x_{t^u-2\Delta t}^s = x_{t^u-\Delta t}^s + \frac{q^i - q_0^m\left(t^u - \Delta t - \frac{x_{t^u-\Delta t}^s}{v_f}\right)}{\rho\left(0, t^u - \Delta t - \frac{x_{t^u-\Delta t}^s}{v_f}\right) - R_e^{-1}(q^i)}\Delta t$$

and proceed recursively until the condition $x_{t^u-k\Delta t}^s \geq l - v_f(t^d - t^u + k\Delta t)$ is met, at which point the incident location can be said to lie within the region $[l - v_f(t^d - t^u + \Delta t), x_{t^u-\Delta t}^s]$.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function (s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 6:
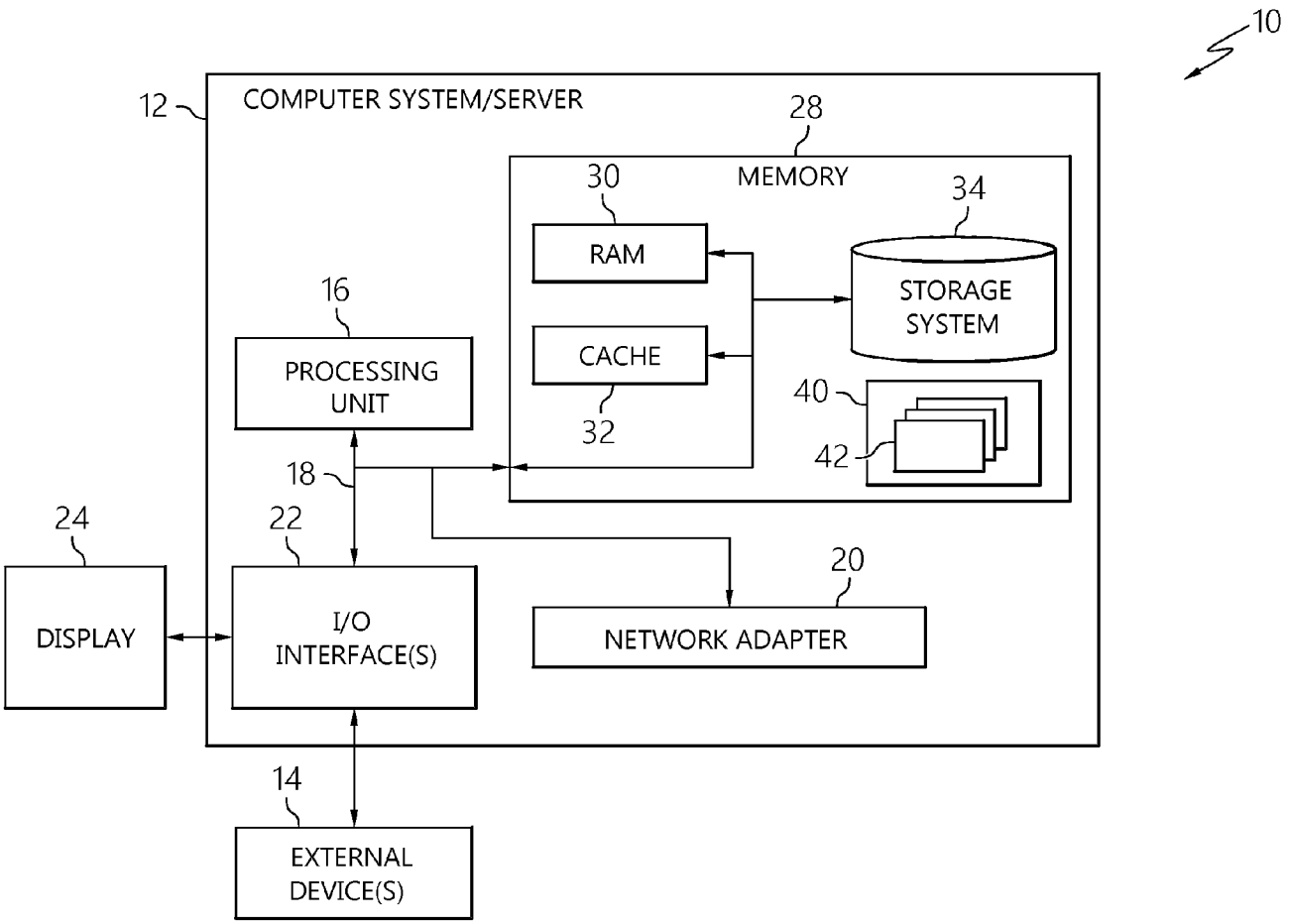
FIG. 6 depicts a cloud computing node according to an embodiment of the present invention.

Referring now to FIG. 6, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 6, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 7:
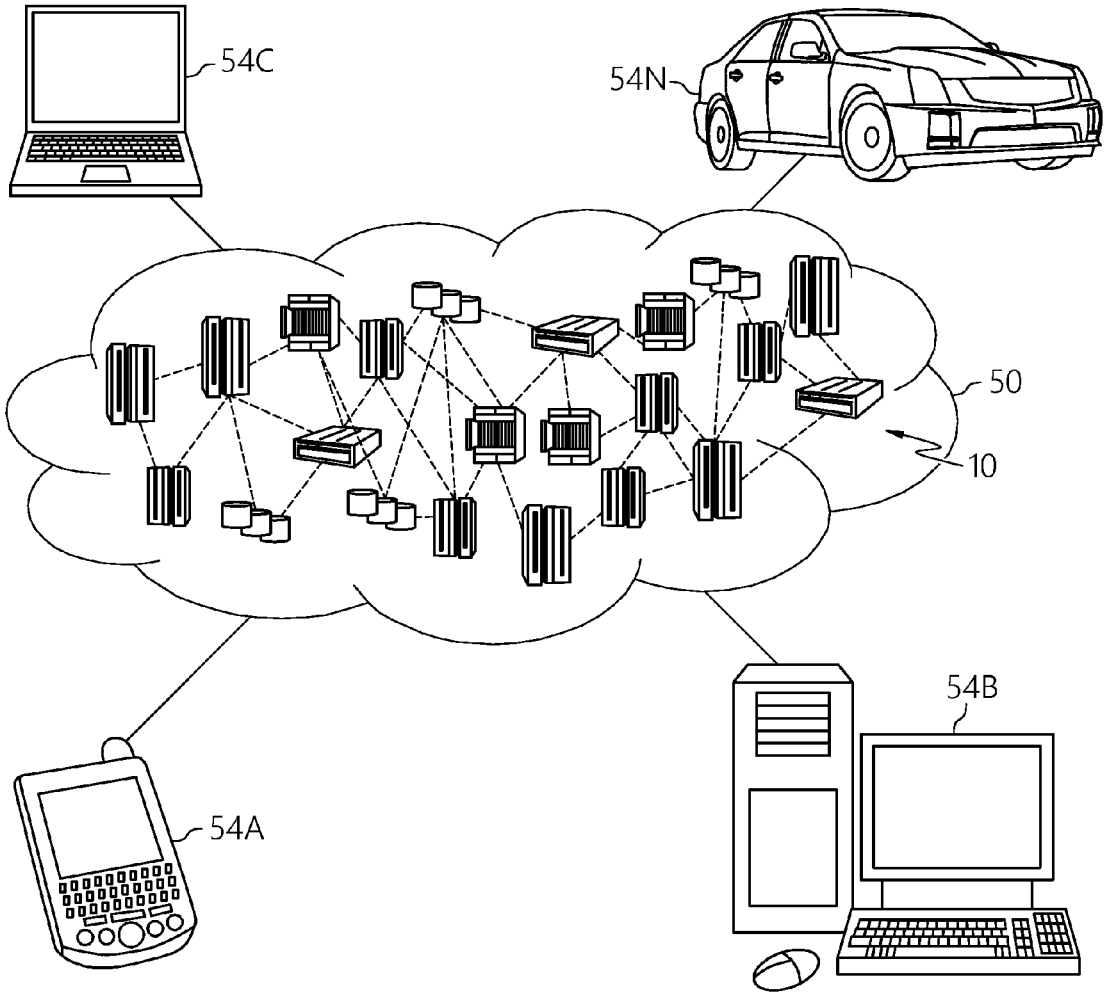
FIG. 7 depicts a cloud computing environment according to an embodiment of the present invention.

Referring now to FIG. 7, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 7 are intended to be illustrative only and that computing nodes 10 and cloud computing environment 50 can communicate with any type of computerized device over any type of network and/or network addressable connection (e.g., using a web browser).

Figure 8:
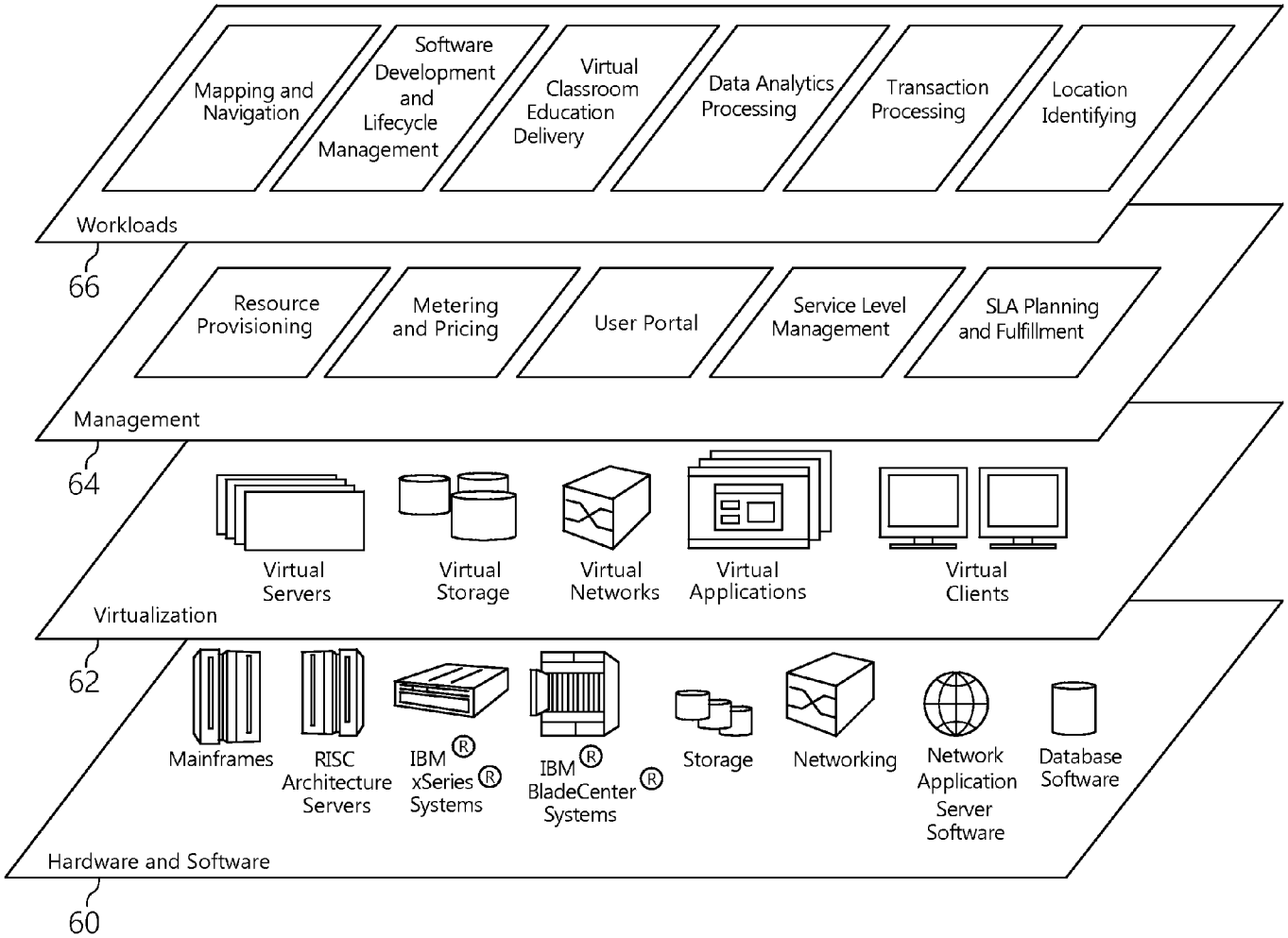
FIG. 8 depicts abstraction model layers according to an embodiment of the present invention.

Referring now to FIG. 8, a set of functional abstraction layers provided by cloud computing environment 50 (FIG. 7) is shown. It should be understood in advance that the components, layers, and functions shown in FIG. 8 are intended to be illustrative only and embodiments of the invention are not limited thereto. As depicted, the following layers and corresponding functions are provided:

Hardware and software layer 60 includes hardware and software components. Examples of hardware components include: mainframes; RISC (Reduced Instruction Set Computer) architecture based servers; storage devices; networks and networking components. In some embodiments, software components include network application server software.

Virtualization layer 62 provides an abstraction layer from which the following examples of virtual entities may be provided: virtual servers; virtual storage; virtual networks, including virtual private networks; virtual applications and operating systems; and virtual clients.

In one example, management layer 64 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide pre-arrangement for, and procurement of, cloud computing resources for which a future requirement is anticipated in accordance with an SLA.

Workloads layer 66 provides examples of functionality for which the cloud computing environment may be utilized. Examples of workloads and functions which may be provided from this layer include: mapping and navigation; software development and lifecycle management; virtual classroom education delivery; data analytics processing; transaction processing; and determining a location for a traffic incident.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A computer implemented method for identifying a location of a traffic incident, from a first sensor and a second sensor, the method comprising:

detecting, based on traffic flow data from the first sensor, a receiving symptom of the traffic incident relative to the first sensor;

detecting, based on traffic flow data from the second sensor, a sending symptom of the traffic incident relative to the second sensor;

determining a location of the first sensor and the second sensor;

creating, based upon traffic flow data from the first sensor and the location of the first sensor, a receiving profile for the receiving symptom;

creating, based upon traffic flow data from the second sensor and the location of the second sensor, a sending profile for the sending symptom;

building, from the receiving and sending profiles, a convergence formula; and identifying, using the convergence formula and based upon a convergence point for the sending and receiving symptoms, a time and the location of the traffic incident.

2. The method of claim 1, wherein the identifying, using the convergence formula comprises:

iteratively determining a distance from a detecting sensor, as a function of time, for each of the sending and receiving symptoms; and identifying, from the distances, a particular point at which the sending and the receiving symptoms converge.

3. The method of claim 1, wherein the creating of the sending profile each comprises:

detecting, from the traffic flow data from the second sensor, traffic conditions that include, relative to the second sensor, a traffic density, a mean rate of flow, and a mean speed of vehicles; and creating, from the traffic conditions and based on the location of the second sensor, the sending profile.

4. The method of claim 3, wherein the creating, from the traffic conditions relative to the second sensor, the sending profile, further comprises:

collecting weather and road condition data relative to the location of the first and second sensors, and adjusting a propagation speed for the sending symptom based upon the weather and the road condition data.

5. The method of claim 1, further comprising transmitting the time and the location of the traffic incident to an alert system.

6. The method of claim 1, further comprising transmitting the time and the location of the traffic incident to a web server.

7. A computer system for identifying a location of a traffic incident, from a first sensor and a second sensor, the system comprising:

at least one processor circuit configured to:

detect, based on traffic flow data from the first sensor, a receiving symptom of the traffic incident relative to the first sensor;

detect, based on traffic flow data from the second sensor, a sending symptom of the traffic incident relative to the second sensor;

determine a location of the first sensor and the second sensor;

create, based upon traffic flow data from the first sensor and the location of the first sensor, a receiving profile for the receiving symptom;

create, based upon traffic flow data from the second sensor and the location of the second sensor, a sending profile for the sending symptom;

build, from the receiving and sending profiles, a convergence formula; and identify, using the convergence formula and based upon a convergence point for the sending and receiving symptoms, a time and the location of the traffic incident.

8. The system of claim 7, wherein the at least one processor circuit is further configured to identify, using the convergence formula, the time and the location of the traffic incident by:

iteratively determining a distance from a detecting sensor, as a function of time, for each of the sending and receiving symptoms; and identifying, from the distances, a particular point at which the sending and the receiving symptoms converge.

9. The system of claim 7, wherein the at least one processor circuit is further configured to create the sending profile by:

detecting, from the traffic flow data from the second sensor, traffic conditions that include, relative to the second sensor, a traffic density, a mean rate of flow, and a mean speed of vehicles; and creating, from the traffic conditions and based on the location of the second sensor, the sending profile.

10. The system of claim 9, wherein the at least one computer processor circuit is further configured to create, from the traffic conditions relative to the second sensor, the sending profile, by:

collecting weather and road condition data relative to the location of the first and second sensors, and adjusting a propagation speed for the sending symptom based upon the weather and the road condition data.

11. The system of claim 7, wherein the at least one computer processor circuit is further configured to transmit the time and the location of the traffic incident to an alert system.

12. The system of claim 7, wherein the at least one computer processor circuit is further configured to transmit the time and the location of the traffic incident to a web server.

13. A computer program product for identifying a location of a traffic incident, from a first sensor and a second sensor, the computer program product comprising a computer readable storage medium having program instructions embodied therewith, wherein the computer readable storage medium is not a transitory signal per se, the program instructions executable by a computer processing circuit to cause the circuit to perform the method comprising:

detecting, based on traffic flow data from the first sensor, a receiving symptom of the traffic incident relative to the first sensor;

detecting, based on traffic flow data from the second sensor, a sending symptom of the traffic incident relative to the second sensor;

determining a location of the first sensor and the second sensor;

creating, based upon traffic flow data from the first sensor and the location of the first sensor, a receiving profile for the receiving symptom;

creating, based upon traffic flow data from the second sensor and the location of the second sensor, a sending profile for the sending symptom;

building, from the receiving and sending profiles, a convergence formula;

identifying, using the convergence formula and based upon a convergence point for the sending and receiving symptoms, a time and the location of the traffic incident.

14. The computer program product of claim 13, wherein the identifying, using the convergence formula comprises:

iteratively determining a distance from a detecting sensor, as a function of time, for each of the sending and receiving symptoms; and identifying, from the distances, a particular point at which the sending and the receiving symptoms converge.

15. The computer program product of claim 13, wherein the creating of the sending profile comprises:

detecting, from the traffic flow data from the second sensor, traffic conditions that include, relative to the second sensor, a traffic density, a mean rate of flow, and a mean speed of vehicles; and creating, from the traffic conditions and based on the location of the second sensor, the sending profile.

16. The computer program product of claim 15, wherein the creating, from the traffic conditions relative to the second sensor, the sending profile, further comprises:

collecting weather and road condition data relative to the location of the first and second sensors, and adjusting a propagation speed for the sending symptom based upon the weather and the road condition data.

17. The computer program product of claim 13, wherein the method further comprises transmitting the time and the location of the traffic incident to an alert system.

18. The computer program product of claim 13, wherein the method further comprises transmitting the time and the location of the traffic incident to a web server.

* * * * *